US005135225A

United States Patent [19]

Pszotka et al.

[11] Patent Number: 5,135,225

[45] Date of Patent: Aug. 4, 1992

[54] OVERLAPPING ROTATABLE DISC TYPE PUZZLE

[76] Inventors: Ede Pszotka; Ede Pszotka, Jr.; Istvanne Sarosi; Edene Pszotka, all of 13/B, Nyul utca 1024, Budapest II, Hungary

[21] Appl. No.: 555,381

[22] PCT Filed: Jul. 19, 1989

[86] PCT No.: PCT/HU89/00037

§ 371 Date: Aug. 2, 1990

§ 102(e) Date: Aug. 2, 1990

[87] PCT Pub. No.: WO90/06793

PCT Pub. Date: Jun. 28, 1990

[30] Foreign Application Priority Data

Dec. 12, 1988 [HU] Hungary ..... 6384/88

[51] Int. Cl.[5] ..... A63F 9/08

[52] U.S. Cl. ..... 273/153 S; 273/155

[58] Field of Search ..... 273/281, 153 R, 153 S, 273/155; 434/401, 402

[56] References Cited

U.S. PATENT DOCUMENTS

| | | | |
|---|---|---|---|
| 3,655,194 | 4/1972 | Pierson | 273/153 S X |
| 4,415,158 | 11/1983 | Engel | 273/153 S |

FOREIGN PATENT DOCUMENTS

| | | | |
|---|---|---|---|
| 8123478 | 1/1982 | Fed. Rep. of Germany | 273/153 S |
| 2490102 | 3/1982 | France | 273/153 S |
| 2538261 | 6/1984 | France | 273/153 S |
| 2116050 | 9/1983 | United Kingdom | 273/153 S |

*Primary Examiner*—Theatrice Brown
*Assistant Examiner*—William M. Pierce
*Attorney, Agent, or Firm*—Kirschstein, Ottinger, Israel & Schiffmiller

[57] ABSTRACT

A puzzle toy has manually-turnable actuators for transferring toy elements from one pocket to another until a desired puzzle solution is obtained.

4 Claims, 5 Drawing Sheets

FIG. 1
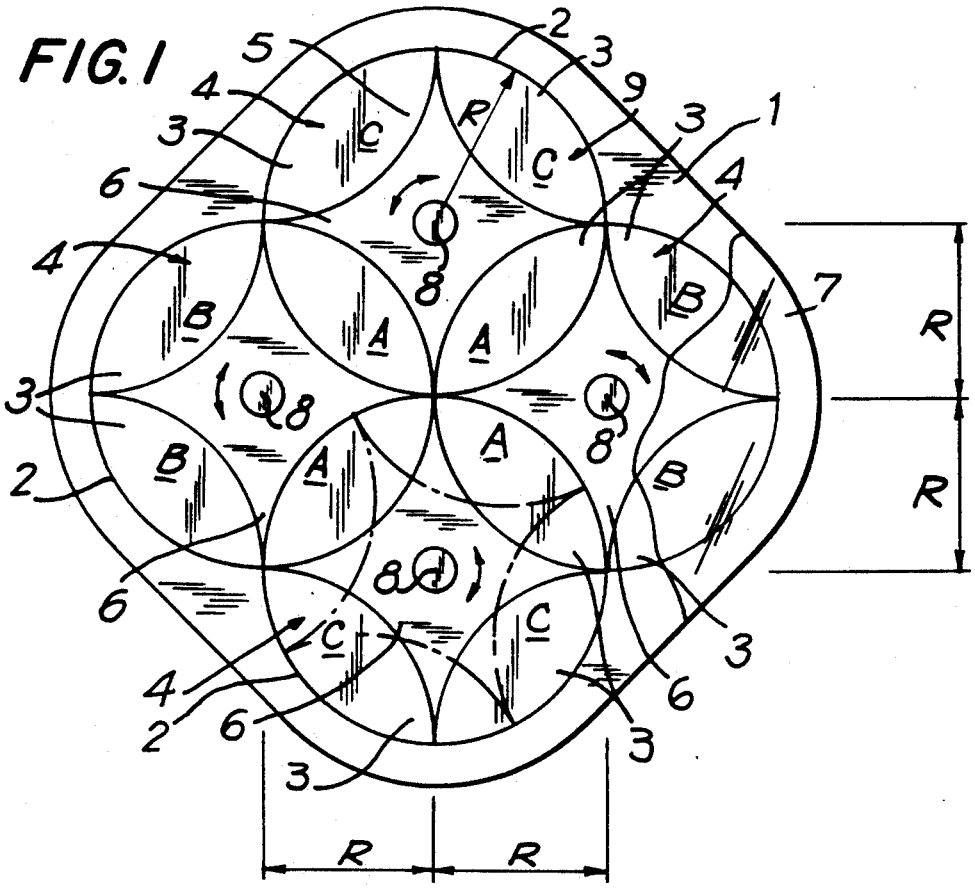
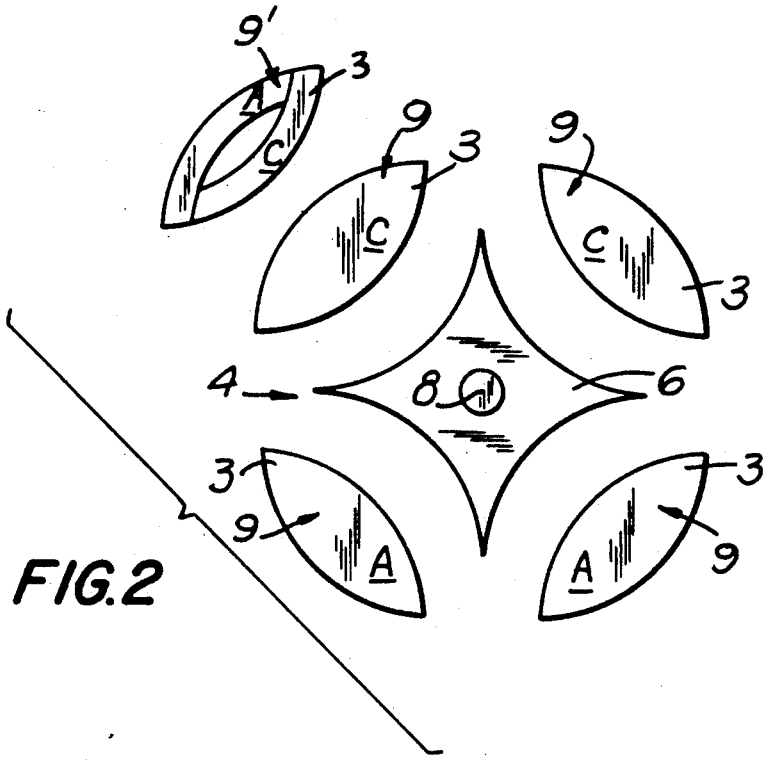
FIG. 2

FIG.3
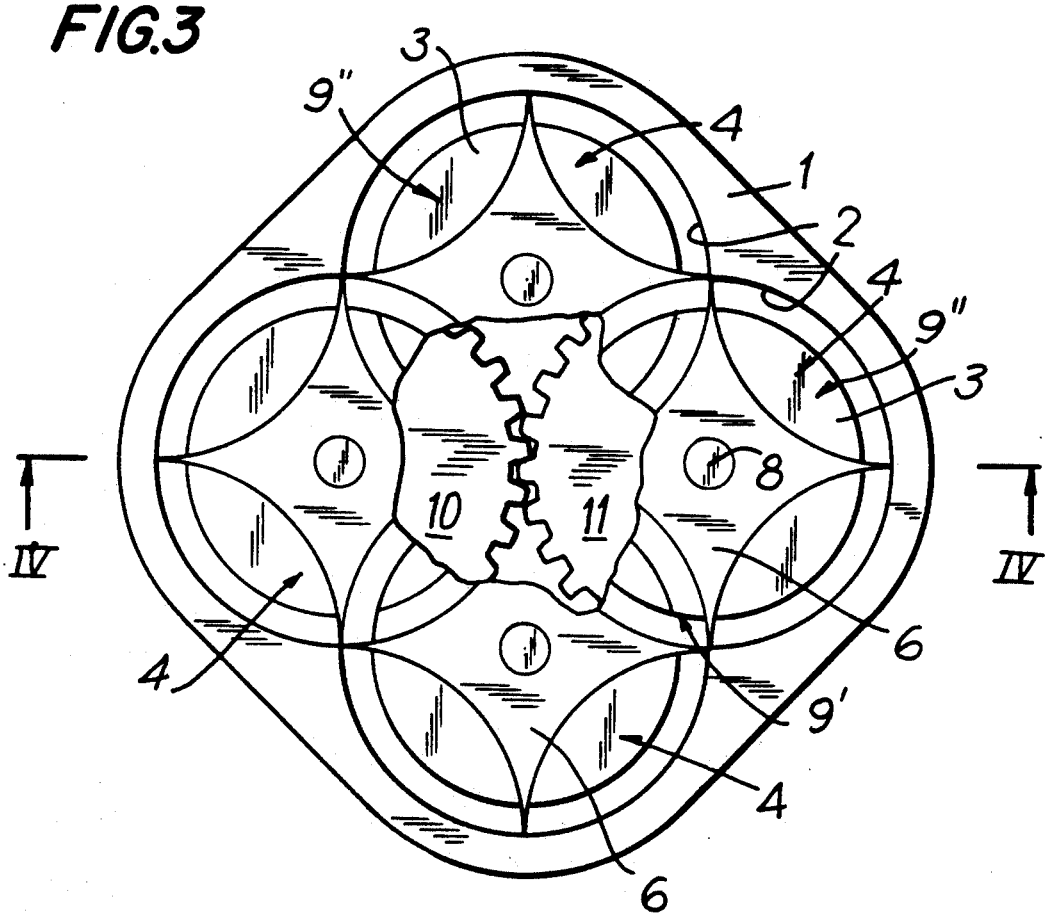
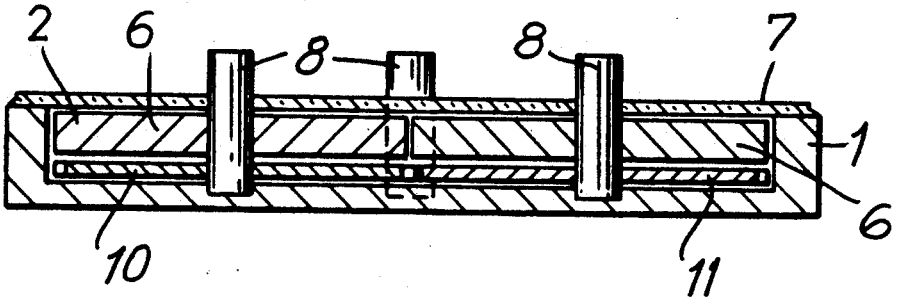
FIG.4

OVERLAPPING ROTATABLE DISC TYPE PUZZLE

BACKGROUND OF THE INVENTION

1. Field of the Invention

This invention generally relates to puzzle toys for the entertainment of persons of all ages.

2. Description of Related Art

It is known to provide puzzle toys wherein a plurality of toy elements are slidably mounted for manual movement by a player along longitudinal rows and transverse columns in a housing. The toy elements are provided with some visible indicia, e.g. a color, a number or a part of a picture. The correct puzzle solution is obtained when the toy elements are re-arranged by the player to form a predetermined color pattern, sequence of numbers, or a picture. Although generally satisfactory for their intended purpose, the known puzzle toys are too difficult to solve for some players, too easy to solve for other players, and, in any event, quickly lose their appeal after the puzzle solution has been obtained.

SUMMARY OF THE INVENTION

1. Objects of the Invention

It is a general object of this invention to provide a puzzle toy of high entertainment reward for persons of all ages.

It is another object of this invention to provide a puzzle toy which is inexpensive to manufacture and is of durable construction.

2. Features of the Invention

In keeping with these objects, and others which will become apparent hereinafter, one feature of this invention resides, briefly stated, in a puzzle toy having a puzzle solution. The toy comprises a housing having concave housing walls at least partly bounding internal circular compartments. Each compartment overlaps at least one adjacent compartment at a generally almond-shaped common area. Each circular compartment has a center, a circular periphery along which a respective concave housing wall extends, and a radial dimension extending from the center to the respective concave housing wall.

The toy further comprises a plurality of manually-turnable actuators, each mounted in a respective compartment for turning movement in either circumferential direction about a turning axis that is coincident with a respective center of the respective compartment. All of the turning axes are arranged along longitudinally-extending rows and transversely-extending columns. Adjacent rows are spaced apart by said radial dimension. Adjacent columns are also spaced apart by said radial dimension. Each actuator has a plurality of concave actuator walls that face and bound generally almond-shaped pockets with respective concave housing walls. The concave actuator walls also face and bound generally almond-shaped pockets with respective concave actuator walls of at least one adjacent actuator.

The toy still further comprises a plurality of generally almond-shaped toy elements, each mounted in respective pockets. The toy elements in the pockets of each actuator are jointly turned during said turning movement thereof about the periphery of the respective compartment in which each actuator is turned to transfer at least one toy element from a pocket of the actuator being turned to another pocket of an adjacent actuator.

The toy yet further comprises indicia on each toy element. The indicia are arranged in a desired visual pattern when the puzzle solution is obtained. Preferably, the indicia are different colors provided either over the entire expanse of an upper surface of each toy element, or along arc-shaped strips on a portion of the upper surface of each toy element.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a partly broken-away, top plan view of a first embodiment of a puzzle toy according to this invention;

FIG. 2 is an exploded top plan view of one actuator and four toy elements of the first embodiment of FIG. 1, together with a variation of one of the toy elements;

FIG. 3 is a partly broken-away, top plan view of a second embodiment of a puzzle toy according to this invention;

FIG. 4 is a sectional view taken on line IV—IV of FIG. 3;

DETAILED DESCRIPTION OF THE PREFERRED EMBODIMENTS

Figure 5:
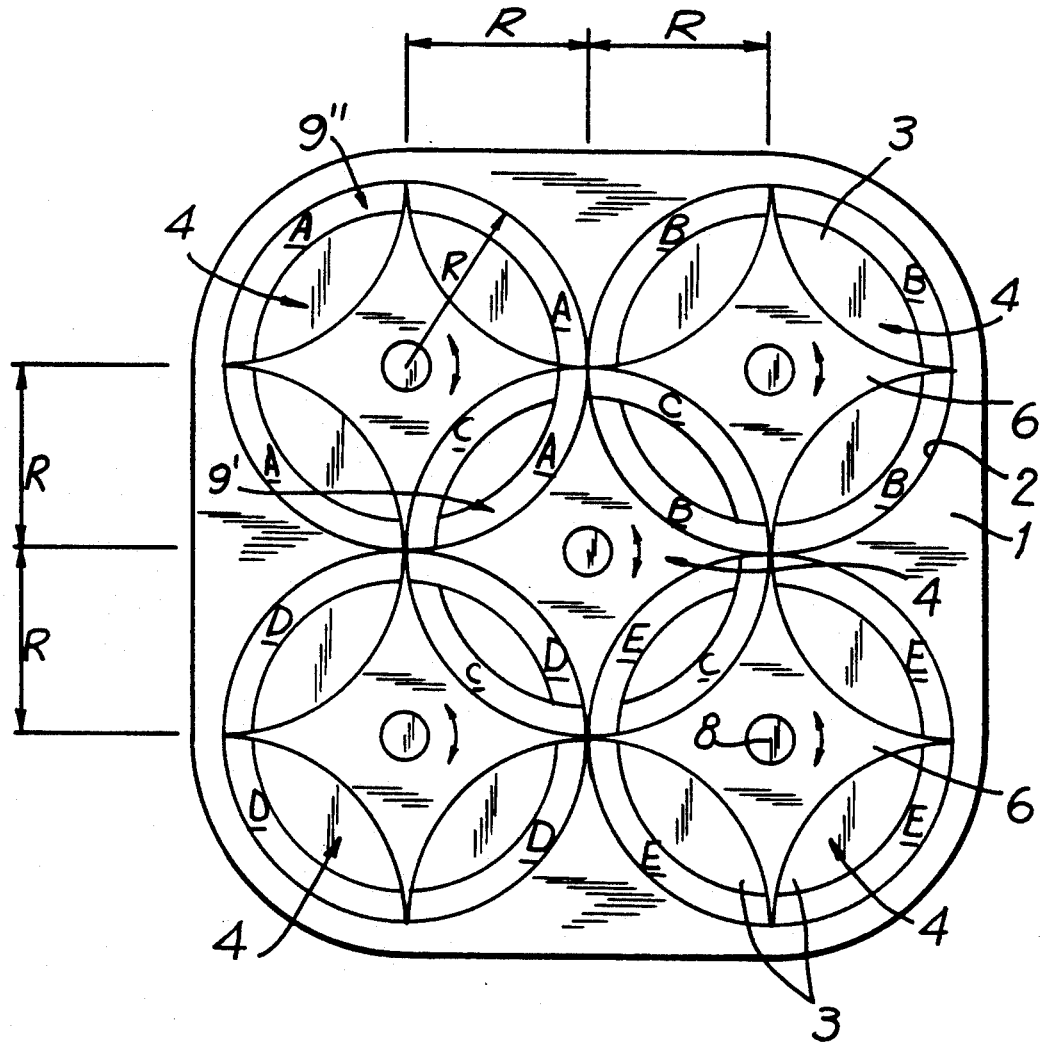
FIG. 5 is a top plan view of a third embodiment of a puzzle toy according to this invention.

Referring now to the drawings, the puzzle toy or game in each embodiment is preferably of miniature size so as to fit in one's pocket or purse. Of course, the puzzle toy can also be made larger for use as a table-top toy. The toy includes a housing 1 having concave housing walls that bound internal circular compartments 2. Four such compartments are shown in FIG. 1. Each compartment 2 overlaps at least one adjacent compartment at generally almond-shaped common areas identified by reference characters A. Each compartment has a center, a circular periphery along which a respective concave housing wall extends, and a radial dimension R extending from the center to the respective concave wall.

A plurality of manually-turnable actuators 6 are each mounted in a respective compartment 2 for turning movement in either circumferential direction about a turning axis that is coincident with a respective center of the respective compartment. The turning axes are arranged along longitudinally-extending rows and transversely-extending columns. Adjacent rows are spaced apart by the radial dimension R. Adjacent columns are also spaced apart by the radial dimension R. As shown in FIG. 1, there are three horizontal rows and three vertical columns. Rows 1 and 3 each have only one turning axis, while row 2 has two turning axes. Columns 1 and 3 each have only one turning axis, while column 2 has two turning axes.

Each actuator 6 has a generally star-shaped hub mounted on a central turning shaft 8 which extends along a respective turning axis and is coincident with the center of a respective compartment. Each actuator has a plurality, preferably four, of concave actuator walls. Two of the actuator walls face and bound generally almond-shaped pockets with two respective concave housing walls. The other two actuator walls face and bound generally almond-shaped pockets with two concave actuator walls of other actuators.

A plurality of generally almond-shaped toy elements 3 are each mounted in the respective pockets. The toy elements 3 are jointly turned during the turning movement of each actuator about the circular periphery of the respective compartment in which each actuator is turned. The four toy elements 3, together with their actuator in whose four pockets they are mounted, constitute a toy unit 4 of which there are four in the embodiment of FIG. 1. The toy units 4 are arranged in a flat playing field 5 so that each two adjacent units 4 overlap each other by the aforementioned common areas A, each of which corresponds to the area of a respective toy element 3.

A transparent cover 7 overlies and closes the housing 1. Each shaft 8 of the actuators extends upwardly through the cover 7 (see FIG. 4) to form a handle which is accessible to be grasped by a player to turn each actuator in either circumferential direction, as indicated by the double-headed arrows. This turning movement turns the four toy elements in the pockets of the actuator being turned. When each actuator is turned 90°, i.e. a quarter turn, at least one of the toy elements 3 is transferred from the actuator being turned to an adjacent actuator.

Indicia 9 (see FIG. 2) are provided on the upper surface of each toy element 3. The indicia can be any information, e.g. colors, numbers, or analogous visually-distinguished information. As described herein, the indicia are a set of different colors, each color being separately identified and labeled by the letters A, B, C. In the embodiment of FIG. 1, each color covers the entire expanse of the upper surfaces of the toy elements 3.

FIG. 1 shows the desired puzzle solution to be arrived at by a player. Initially, the toy elements are not oriented in the illustrated puzzle solution, but, instead, are jumbled. The player turns one of the actuators a quarter turn and transfers the colored toy element from the pocket of one actuator to the pocket of another actuator until the puzzle solution is obtained.

FIG. 2 shows one of the toy units 4 with the FIG. 1 embodiment in exploded view. The almond-shaped toy elements 3 can also be described as ovals with pointed ends, or as plates having opposite concavely-curved sides. Reference numeral 9' in FIG. 2 shows a representative toy element 3 which has two oppositely-curved arc-shaped strips of different colors, e.g. A and C, and represents a variant to the toy element 3 whose entire upper surface was colored by a single color, i.e. A, B or C.

Turning now to FIGS. 3 and 4, these are analogous to the embodiment of FIG. 1. Hence, like reference numerals have been used to identify like parts. Rather than the entire upper surface of each toy element being colored with a single color, or having the upper surface of each toy element covered with two arc-shaped strips of different colors, reference numeral 9" identifies a representative toy element 3 having a single arc-shaped strip as its indicium.

In addition, rather than having each actuator independently turnable relative to the other actuators, a set of meshing gears 10, 11 are mounted on the shafts 8 of non-overlapping actuators 6. This meshing engagement further complicates the puzzle solution since, when the toy unit on the right in FIG. 3 is turned, the toy unit 4 on the left will also turn in the opposite direction—a feature which must be taken into account by the player.

FIG. 5 represents another embodiment wherein five toy units 4 are arranged on the housing 1. Like reference numerals to those employed earlier have been used. To accommodate the greater number of actuators and toy elements, additional colors D and E have been provided. It should be noted that, of the four toy elements for each actuator, three are provided with single colored arc-shaped regions 9", whereas the remaining fourth is provided with a pair of arc-shaped regions 9'. FIG. 5 illustrates the desired puzzle solution wherein five differently colored rings intersect one another. In FIG. 5, the turning axes are arranged on and along an X-shaped pattern.

Figure 6:
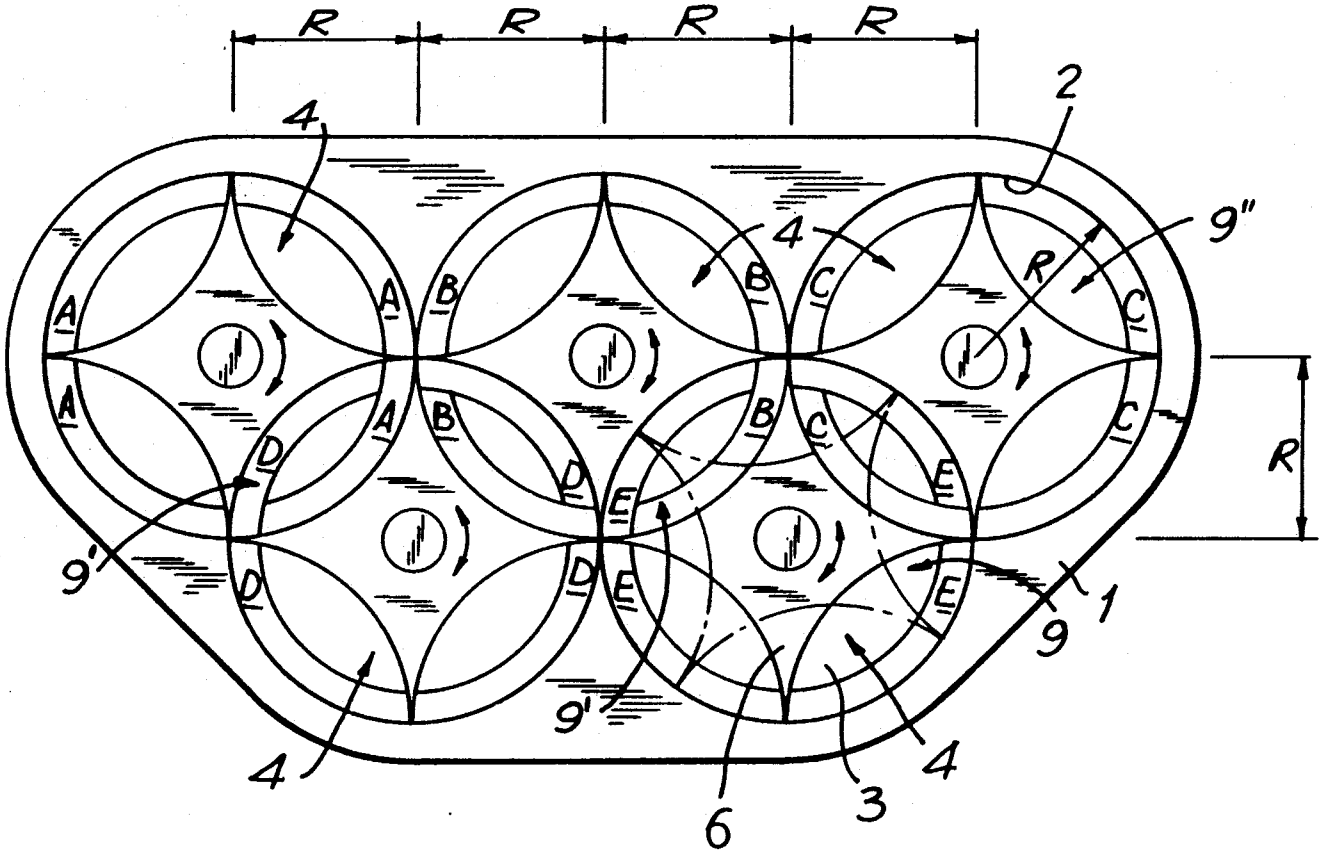
FIG. 6 is a top plan view of a fourth embodiment of a puzzle toy according to this invention.

Turning now to FIG. 6, another puzzle toy embodiment having five toy units is illustrated. Rather than arranging the turning axes in an X-shaped pattern, the turning axes of the FIG. 6 embodiment are arranged along two rows. The first row has three turning axes; the second row has two turning axes; and the second row is staggered relative to the first row. Again, the rows are spaced apart by the radial dimension R, and the columns are also spaced apart by the radial dimension R. As illustrated in FIG. 6, the five differently colored rings intersect one another in the puzzle solution, and depict the "five-ring Olympic symbol".

Figure 7:
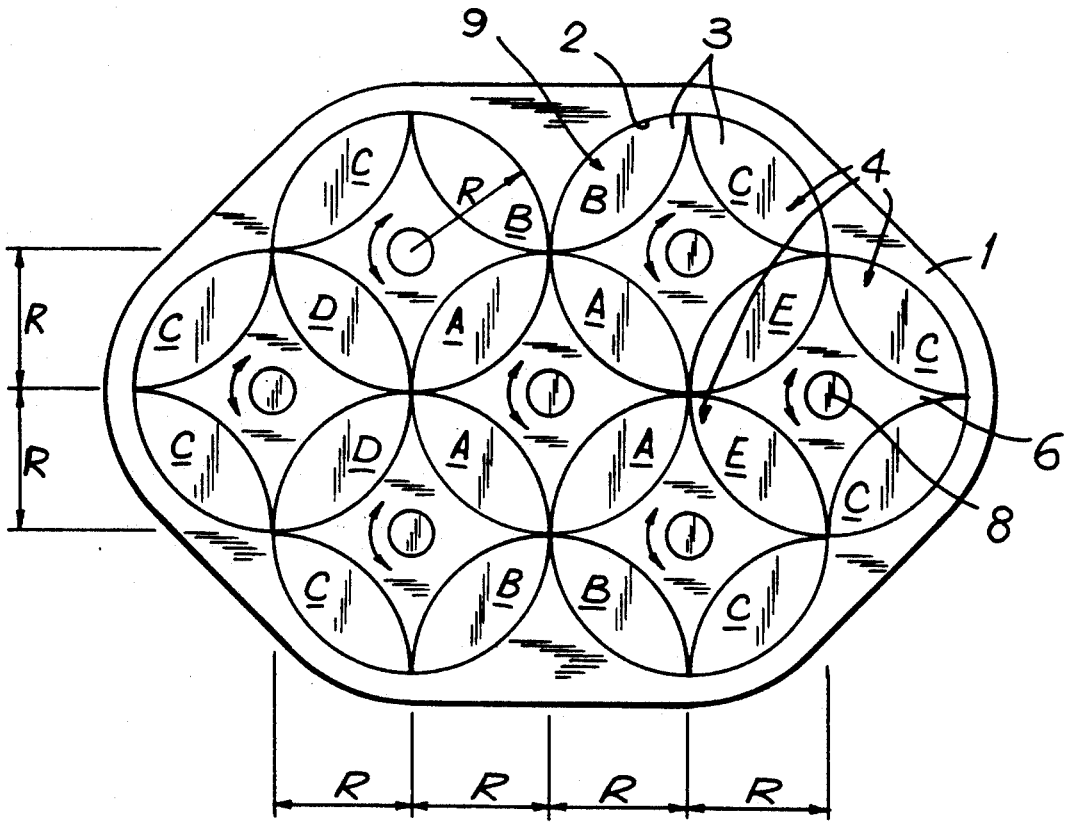
FIG. 7 is a top plan view of a fifth embodiment of a puzzle toy according to this invention.

FIG. 7 represents still another embodiment wherein seven toy units are arranged in three rows and five columns. Like reference numerals have been employed as before.

The complexity of the game and the difficulty of its solution increase in proportion to the number of toy units. Of course, this invention is not intended to be limited to the use of four, five or seven toy units, since other arrangements and combinations are within the spirit of this invention.

In addition, the actuator 6 need not have a star-shaped hub as illustrated, but may have other configurations. Rather than turning each actuator as described above, a transmission system can be used wherein individual parts of the transmission are engaged by pressing the actuator along the axial direction against a return spring.

As previously noted, each actuator is turned through a quarter turn to transfer at least one toy element from one pocket to another. A spring-loaded detent may be employed to lock the actuator in each of its four quarter-turn positions. For this purpose, a set of four sockets or recesses are provided on each actuator corresponding to 90°, 180°, 270° and 360°. A spring-loaded ball is loaded against the actuator and is affirmatively urged and locked into one of these recesses during each quarter turn.

It will be understood that each of the elements described above, or two or more together, also may find a useful application in other types of constructions differing from the types described above.

While the invention has been illustrated and described as embodied in a puzzle toy, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. A puzzle toy, comprising:

(a) a housing having only five circular compartments having respective centers, each compartment having a radial dimension that is identical for all the compartments, three of the compartments being successively arranged in a tangential relationship along a first linear row with the centers of said three compartments lying on a first common centerline, the remaining two of the compartments being successively arranged in a tangential relationship along a second linear row with the centers of said remaining two compartments lying on a second common centerline, said first and second centerlines being parallel to each other and spaced apart by said radial dimension along a transverse direction, said centers of said two compartments of said second row being spaced apart by said radial dimension along a longitudinal direction normal to said transverse direction relative to the centers of said three compartments of said first row, each of said two compartments of said second row overlapping a pair of said three compartments of said first row at common oval areas;

(b) a plurality of manually turnable actuators, each mounted in a respective compartment for turning movement in either circumferential direction about a turning axis that is coincident with a respective center of the respective compartment, each actuator having four oval pockets, each pocket being of identical size to that of said respective oval areas; and (c) a plurality of oval toy elements, each mounted in a respective pocket of a respective actuator, said toy elements including a first group, each having a single arc-shaped colored strip on an upper surface of a respective element of said first group, and a second group, each having a pair of oppositely curved arc-shaped dual-colored strips intersecting at both opposite ends thereof on an upper surface of a respective element of said second group.

2. The puzzle toy according to claim 1, wherein the housing includes a base and a transparent cover through which the toy elements are visible, and wherein each actuator includes a handle that extends through the cover.

3. The puzzle toy according to claim 1, wherein each actuator is independently movable.

4. The puzzle toy according to claim 1, wherein two of the actuators include rotary gears in meshing engagement with each other.

* * * * *